US011293379B1

(12) United States Patent
Liu

(10) Patent No.: US 11,293,379 B1
(45) Date of Patent: Apr. 5, 2022

(54) CARBURETOR WITH ADJUSTING TOOL FOR GARDEN MACHINERY ENGINE WITH ANTI-FLOW TAMPERING FUNCTION

(71) Applicant: Jiagang Liu, Tianjin (CN)

(72) Inventor: Jiagang Liu, Tianjin (CN)

( * ) Notice: Subject to any disclaimer, the term of this patent is extended or adjusted under 35 U.S.C. 154(b) by 0 days.

(21) Appl. No.: 17/034,559

(22) Filed: Sep. 28, 2020

(51) Int. Cl.

| | |
|---|---|
| ***F02M 9/10*** | (2006.01) |
| ***F02M 3/10*** | (2006.01) |
| ***F02B 63/02*** | (2006.01) |
| ***F02M 19/04*** | (2006.01) |

(52) U.S. Cl.
CPC ..... *F02M 9/103* (2013.01); *F02B 63/02* (2013.01); *F02M 3/10* (2013.01); *F02M 19/04* (2013.01)

(58) Field of Classification Search
CPC .... Y10S 261/38; Y10S 261/08; Y10S 261/67; F02M 19/04; F02M 2003/105; F02M 3/10; F02M 9/08; F02M 9/103; F02M 7/18; F02M 1/00; F02M 3/08; F02M 1/043; F02M 9/02; F02M 19/01; F02M 19/02; F02M 19/08; F02M 31/045; F02M 31/066; F02M 35/1017; F02M 3/02; F02M 9/127; F02B 63/02
See application file for complete search history.

(56) References Cited

U.S. PATENT DOCUMENTS 5,133,905 A * 7/1992 Woody ..... F02M 7/11 261/35
5,603,869 A * 2/1997 McNew et al. ..... F02M 3/08
5,709,822 A * 1/1998 Togashi ..... F02M 7/14 261/44.2
5,984,281 A * 11/1999 Hacker ..... F02B 63/02 137/382
2005/0146061 A1* 7/2005 Burns ..... F02M 7/18 261/58
2017/0122262 A1* 5/2017 Xue ..... F02M 3/10

FOREIGN PATENT DOCUMENTS

GB 1560109 A * 1/1980 ..... B25B 15/005

* cited by examiner

*Primary Examiner* — George C Jin
*Assistant Examiner* — Teuta B Holbrook

(57) ABSTRACT

The present utility model relates to a carburetor with adjusting tool for garden machinery engine with anti-flow tampering function. The carburetor is comprised of a carburetor body, an idle oil needle, an oil needle spring, a plunger nut, a flow adjusting nail, a flow nail spring, a gasket and a sealing ring, wherein the idle oil needle and the flow adjusting nail are both provided with a special tool adjusting part, the special tool adjusting part is comprised of a section of cylinder, and the surface of the cylinder is provided with a micro wedge-shaped adjusting structure in the axial direction. In the present utility model, the flow and opening of the carburetor can only be adjusted using a special tool by changing the structure of the idle oil needle and the flow adjusting nail, which can effectively avoid the problem that the state of the carburetor is adjusted by users by using a common screwdriver, which causes the engine to fail to work normally or even be damaged due to improper adjustment, thus resulting in unnecessary after-sales service work, guaranteeing that the state as delivered is not easy to be freely adjusted by users, thus effectively ensuring the low emission value.

8 Claims, 8 Drawing Sheets

CARBURETOR WITH ADJUSTING TOOL FOR GARDEN MACHINERY ENGINE WITH ANTI-FLOW TAMPERING FUNCTION

TECHNICAL FIELD

The present utility model belongs to the technical field of garden machinery, and particularly relates to a carburetor with adjusting tool for garden machinery engine with anti-flow tampering function.

BACKGROUND ART

With regard to the carburettor for garden machinery engine with anti-flow tampering function of common structure in the prior art, the carburettor flow nail can be adjusted by users by using a common screwdriver, which often causes the engine to fail to work normally or even be damaged due to improper adjustment, resulting in unnecessary after-sales service.

SUMMARY OF THE UTILITY MODEL

The purpose of the present utility model is to solve the above technical problem and provide a carburetor for garden machinery engine with anti-flow tampering function, ensuring that the carburetor is in the state as delivered, and is not easy to be freely adjusted by users, so as to avoid affecting the performance of the carburetor.

In order to achieve the above purpose, the present utility model adopts the following technical solution:

The carburetor is comprised of a carburetor body, an idle oil needle, an oil needle spring, a plunger nut, a flow adjusting nail, a flow nail spring, a gasket and a sealing ring, wherein the idle oil needle and the flow adjusting nail are both provided with a special tool adjusting part, the special tool adjusting part is comprised of a section of cylinder, and the surface of the cylinder is provided with a micro wedge-shaped adjusting structure in the axial direction.

The idle oil needle is provided with a special tool adjusting part for the idle oil needle, which is comprised of a section of cylinder, and the surface of the cylinder is provided with a micro wedge-shaped adjusting structure in the axial direction.

The flow adjusting nail is provided with a special tool adjusting part for flow adjusting nail, which is comprised of a section of cylinder, and the surface of the cylinder is provided with a micro wedge-shaped adjusting structure in the axial direction.

The carburetor adjusting tool for garden machinery engine with anti-flow tampering function is characterized in that the adjusting tool is provided with a special adjusting structure, the inner wall annular surface of the special tool hole is a glossy surface, and the glossy surface is provided with a section of inclined micro wedge-shaped structure in the axial direction.

In the present utility model, the flow of the carburetor can only be adjusted using a special tool by changing the structure of the idle oil needle and the flow adjusting nail, which can effectively avoid the problem that the flow adjusting nail of the carburetor is adjusted by users by using a common screwdriver, which causes the engine to fail to work normally or even be damaged due to improper adjustment, thus resulting in unnecessary after-sales service work, guaranteeing that the state as delivered is not easy to be freely adjusted by users, thus effectively ensuring the low emission value.

DETAILED DESCRIPTION OF PREFERRED EMBODIMENTS

The substantive features and advantages of the present utility model will be further explained with examples, but the utility model is not limited to the listed embodiments.

Figure 1:
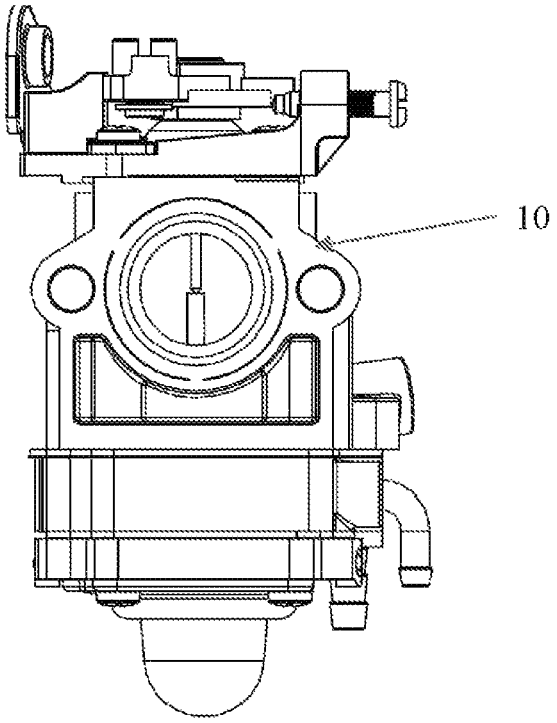
FIG. 1 is a schematic outline diagram of the carburetor provided by the embodiment of the present utility model.
Figure 2:
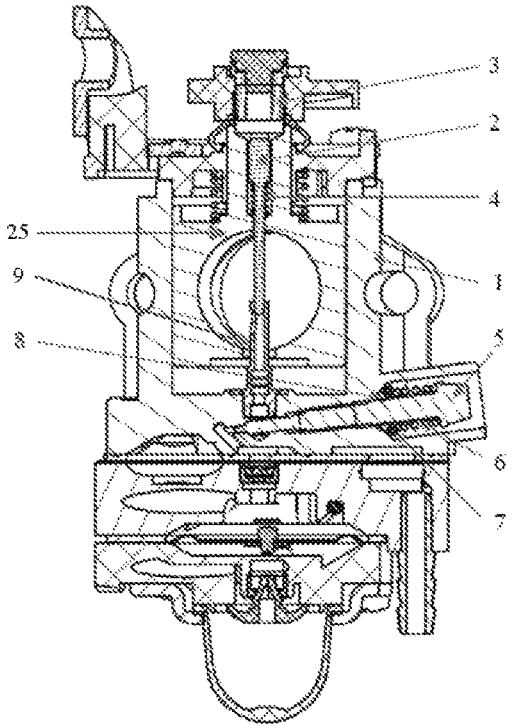
FIG. 2 is a schematic sectional view of the carburetor provided by the embodiment of the present utility model.
Figure 3:
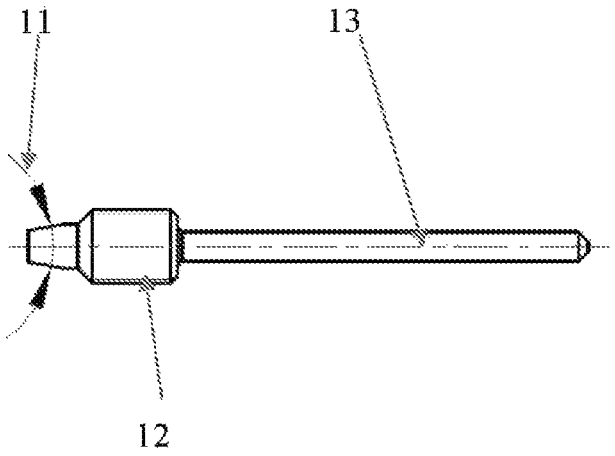
FIG. 3 is a schematic front view of the idle oil needle provided by the embodiment of the present utility model.
Figure 4:
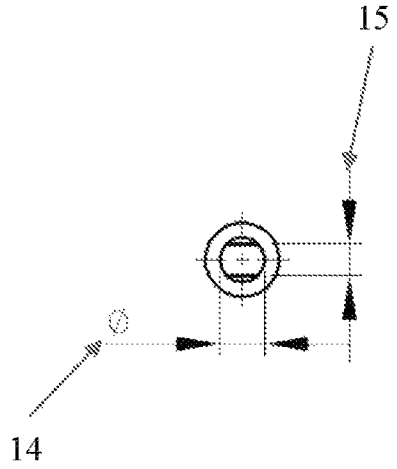
FIG. 4 is a side view of the idle oil needle.

As shown in FIG. 1-FIG. 6, a carburetor for garden machinery engine with anti-flow tampering function is comprised of a carburetor 10, which is provided with a carburetor body 1, an idle oil needle 2, a flow adjusting nail 5, a plunger nut 3, an oil needle spring 4, a flow spring 6, a gasket 7 and a sealing ring 8. As shown in FIG. 3-FIG. 4, the idle oil needle 2 is provided with a special tool adjusting part for idle oil needle, the special tool adjusting part for idle oil needle is comprised of a section of cylinder 14, and the surface of the cylinder is provided with a section of micro wedge-shaped inclined plane 11 in the axial direction, wherein the cylinder 14 is connected with a rod-shaped oil needle body 13 of the idle oil needle through a threaded section 12, and works in coordination with an oil nozzle 9 to adjust the idle flow. The coordination between the oil needle 2 and the plunger 25 is fixed by the oil needle spring 4. The diameter of the threaded section 12 is larger than that of the cylinder 14. In particular, an angle of the micro wedge-shaped inclined plane 11 of the micro wedge-shaped adjusting structure of the cylinder 14 measured against a longitudinal axis of the cylinder 14 of the idle oil needle 2 may lie in an open interval of (1°,180°), and a width of a micro wedge-shaped flat mouth 15 of the micro wedge-shaped adjusting structure of the cylinder 14 of the idle oil needle 2 may lie in the range of 0.1 mm~100 mm, and a cross-sectional area of the micro wedge-shaped cylinder 14 may lie in the range of 0.01 $mm^2$~500 $mm^2$.

Figure 5:
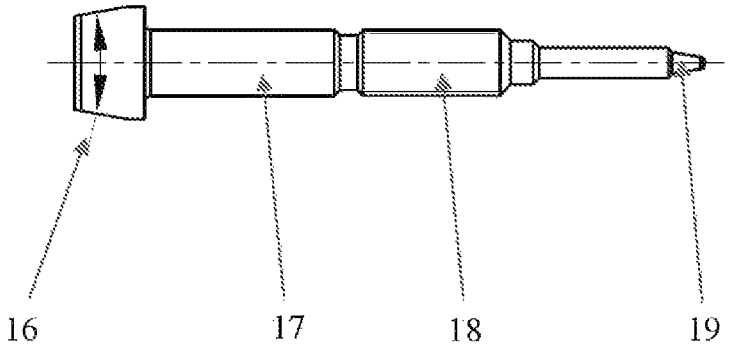
FIG. 5 is a schematic front view of the flow adjusting nail provided by the embodiment of the present utility model.
Figure 6:
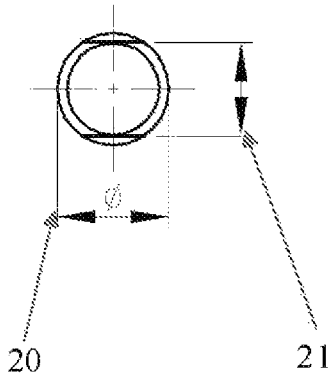
FIG. 6 is a side view of the flow adjusting needle.

As shown in FIG. 5-FIG. 6, the flow adjusting nail 5 is provided with a special tool adjusting part for flow adjusting nail, which is comprised of an outer cylinder 20, and the surface of the cylinder is provided with a micro wedge-shaped inclined surface 16 in the axial direction, which can adjust the flow in coordination with the carburetor body 1 through the flow nail cone tip 19 after the transition of the round rod 17 and the threaded section 18. The flow adjusting nail is fixed by the spring 6, and the coordination between the flow adjusting nail and the body 1 is sealed through the gasket 7 and the sealing ring 8. In particular, an angle of the micro wedge-shaped inclined surface 16 of the micro wedge-shaped adjusting structure of the outer cylinder 20 measured against a longitudinal axis of the outer cylinder 20 of the flow adjusting nail 5 may lie in an open interval of (1°,180°), a width of a micro wedge-shaped flat mouth 21 of the micro wedge-shaped adjusting structure of the outer cylinder 20 of the flow adjusting nail 5 may lie in the range of 0.1 mm~100 mm, and a cross-sectional area of the micro wedge-shaped cylinder 20 may lie in the range of 0.01 $mm^2$~500 $mm^2$.

Figure 7:
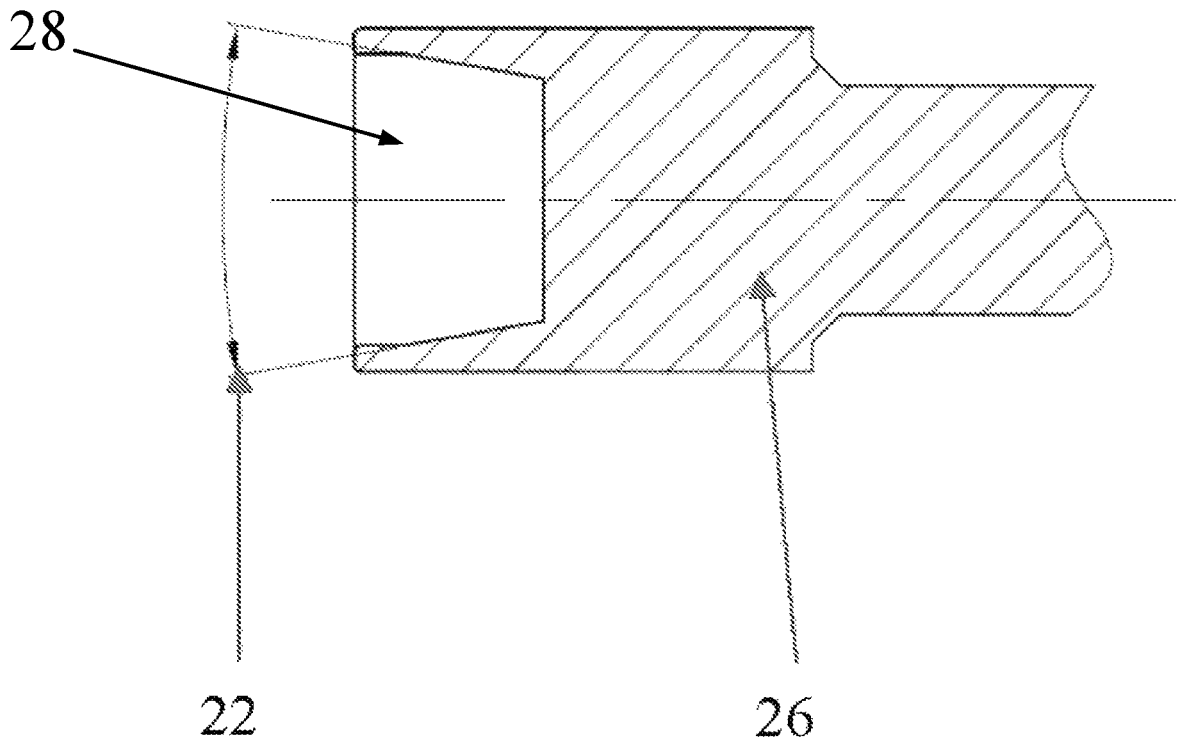
FIG. 7 is a schematic front view of the adjusting tool provided by the embodiment of the present utility model.
Figure 8:
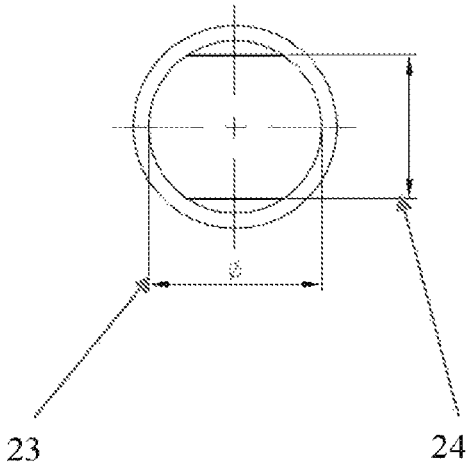
FIG. 8 is a side view of the adjusting tool bit.

As shown in FIG. 7-FIG. 8, the special adjusting structure of the special adjusting tool 26 for the micro wedge-shaped inclined surface is comprised of an inner round section 23, and the surface of the cylinder is provided with a section of micro wedge-shaped inclined plane 22 in the axial direction. As is illustrated in FIG. 7, there is defined a special tool hole 28 in one end of the special adjusting structure, and the special tool hole 28 has the above mentioned micro wedge-shaped inclined surface. The special micro wedge-shaped adjusting tool 26 is specially used for adjusting the micro wedge-shaped idle oil needle and the flow adjusting nail.

It can be seen from the above that in the present utility model, the flow of the carburetor can only be adjusted using a special tool 26 by changing the structure of the idle oil needle and the flow adjusting nail, which can effectively avoid the problem that the flow adjusting nail of the carburetor is adjusted by users by using a common screwdriver, which causes the engine to fail to work normally or even be damaged due to improper adjustment, thus resulting in unnecessary after-sales service work, guaranteeing that the state as delivered is not easy to be freely adjusted by users, thus effectively ensuring the low emission value.

The above is only the preferred embodiment of the present utility model. It should be noted that for ordinary technicians in this technical field, without departing from the principle of the present utility model, some improvements and embellishments can be made, which should also be regarded as the protection scope of the present utility model.

What is claimed is:

1. A carburetor with a special adjusting tool for a garden machinery engine with anti-flow tampering function, wherein the carburetor (10) comprises a carburetor body (1), an idle oil needle (2), an oil needle spring (4), a plunger nut (3), a flow adjusting nail (5), a flow nail spring (6), a gasket (7), and a sealing ring (8), wherein the idle oil needle (2) and the flow adjusting nail (5) each comprises a special adjusting tool (26), which comprises a section of cylinder, and a surface of the cylinder comprises a micro wedge-shaped adjusting structure in an axial direction at one end of the cylinder; wherein the special adjusting tool (26) comprises a special adjusting structure, which comprises a special tool hole (28) at one end of the special adjusting structure, wherein an inner wall annular surface of the special tool hole (28) is a glossy surface, and the glossy surface comprises an inclined micro wedge-shaped structure in the axial direction, wherein the inclined micro wedge-shaped structure of the special tool hole (28) matches and is operative to be engaged with the micro wedge-shaped adjusting structure disposed at the end of the cylinder of the idle oil needle (2) or the flow adjusting nail (5), and the special adjusting tool (26) is configured to cause the special tool hole (28) to be engaged with the micro wedge-shaped adjusting structure to adjust the idle oil needle (2) or the flow adjusting nail (5).

2. The carburetor with a special adjusting tool for a garden machinery engine with anti-flow tampering function according to claim 1, wherein the idle oil needle (2) comprises a special tool adjusting part, which comprises a section of cylinder (14), and a surface of the cylinder (14) comprises a micro wedge-shaped adjusting structure in the axial direction of the cylinder (14).

3. The carburetor with an adjusting tool for a garden machinery engine with anti-flow tampering function according to claim 1, wherein the flow adjusting nail (5) comprises a special tool adjusting part, which comprises a section of cylinder (20), and a surface of the cylinder (20) comprises a micro wedge-shaped adjusting structure in the axial direction at one end of the cylinder (20).

4. The carburetor with an adjusting tool for a garden machinery engine with anti-flow tampering function according to claim 1, wherein the idle oil needle (2) comprises a special tool adjusting part, which comprises a section of cylinder (14), and the surface of the cylinder (14) comprises a micro wedge-shaped adjusting structure in an axial direction at one end of the cylinder (14), and wherein an angle of a micro wedge-shaped inclined plane (11) of the micro wedge-shaped adjusting structure of the cylinder (14) measured against a longitudinal axis of the cylinder (14) of the idle oil needle (2) lies in the open interval of (1°,180°); wherein a width of a micro wedge-shaped flat mouth (15) of the micro wedge-shaped adjusting structure of the cylinder (14) of the idle oil needle (2) lies in the range of 0.1 mm~100 mm; and a cross-sectional area of the micro wedge-shaped cylinder (14) lies in the range of 0.01 mm2~500 mm2.

5. The carburetor with an adjusting tool for a garden machinery engine with anti-flow tampering function according to claim 1, wherein the flow adjusting nail (5) comprises a special tool adjusting part, which comprises a section of cylinder (20), and the surface of the cylinder (20) comprises a micro wedge-shaped adjusting structure in the axial direction at one end of the cylinder (20), and wherein an angle of the micro wedge-shaped inclined plane (16) of the micro wedge-shaped adjusting structure of the cylinder (20) measured against a longitudinal axis of the cylinder (20) of the flow adjusting nail (5) lies in the open interval of (1°,180°); wherein a width of a micro wedge-shaped flat mouth (21) lies in the range of 0.1 mm~100 mm; and a cross-sectional area of the micro wedge-shaped cylinder (20) lies in the range of 0.01 mm2~500 mm2.

6. The carburetor with an adjusting tool for a garden machinery engine with anti-flow tampering function according to claim 1, wherein for the special adjusting tool (26), wherein an angle of a micro wedge-shaped inclined plane (22) of the special tool hole (28) of the special adjusting tool (26) measured against a longitudinal axis of the special adjusting tool (26) lies in the open interval of (1°,180°); wherein a width of a micro wedge-shaped bottom flat mouth (24) of the special tool hole (28) of the special adjusting tool (26) lies in the range of 0.1 mm~100 mm; and a cross-sectional area of a micro wedge-shaped cylindrical section (23) of the special tool hole (28) of the special adjusting tool (26) lies in the range of 0.01 mm2~500 mm2.

7. The carburetor with an adjusting tool for a garden machinery engine with anti-flow tampering function according to claim 1, wherein the idle oil needle (2) and the flow adjusting nail (5) are such arranged that a longitudinal axis of the idle oil needle (2) is obliquely oriented relative to a longitudinal axis of the flow adjusting nail (5).

8. The carburetor with an adjusting tool for a garden machinery engine with anti-flow tampering function according to claim 1, wherein the longitudinal axis of the idle oil needle (2) and the longitudinal axis of the flow adjusting nail (5) form an angle that lies in the open interval of (1°,90°).

* * * * *